US005482165A

United States Patent [19]

Johnston

[11] Patent Number: 5,482,165

[45] Date of Patent: Jan. 9, 1996

[54] MOBILE GRAVEL SCREENING APPARATUS

[76] Inventor: Rafe Johnston, R.F.D. #3, Box 366A, Caribou, Me. 04736

[21] Appl. No.: 258,220

[22] Filed: Jun. 10, 1994

[51] Int. Cl.[6] ..... B07B 1/34; B07B 1/49

[52] U.S. Cl. ..... 209/244; 209/346; 209/409; 209/420; 209/935

[58] Field of Search ..... 209/243, 244, 209/409, 410, 411, 412, 420, 421, 910, 935, 346

[56] References Cited

U.S. PATENT DOCUMENTS

| | | | |
|---|---|---|---|
| 4,237,000 | 12/1980 | Read et al. | 209/420 X |
| 4,256,572 | 3/1981 | Read | 209/420 X |
| 4,699,713 | 10/1987 | Tieben | 209/420 X |
| 4,923,597 | 5/1990 | Anderson et al. | 209/935 X |
| 5,106,490 | 4/1992 | McDonald | 209/420 X |
| 5,368,167 | 11/1994 | Howes | 209/409 X |

FOREIGN PATENT DOCUMENTS

| | | | |
|---|---|---|---|
| 3418830 | 11/1985 | Germany | 209/420 |

*Primary Examiner*—William E. Terrell
*Assistant Examiner*—Tuan Nguyen
*Attorney, Agent, or Firm*—Frederick R. Cantor

[57] ABSTRACT

A mobile screening apparatus for gravel and other aggregates includes a three sided box adapted to rest on the ground surface. A vibrating screen is located above the box in a tilted, or sloped condition, so that gravel deposited on the screen is in a fluidized condition. Relatively fine gravel particles (stones) pass downwardly through the screen into the box. Two upwardly divergent trough walls are rigidly secured to side edges of the screen to guide gravel particles onto the screen. A rotary motor and counterweight system is mounted on the undersurface of the screen to oscillate the screen in a generally vertical direction. The motor and counterweight system are exposed so as to be readily accessible for inspection or maintenance purposes.

7 Claims, 2 Drawing Sheets

MOBILE GRAVEL SCREENING APPARATUS

BACKGROUND OF THE PRESENT INVENTION

1.Field of the Invention

The present invention relates to a mobile gravel screening apparatus.

The present invention, more particularly, relates to a mobile gravel screening apparatus having a sloped screen, and means for vibrating the screen to promote the flow of gravel through the apparatus.

2. Prior Developments

It is known that aggregate mixtures can be separated into different particle size fractions by depositing such aggregate mixtures onto a sloped screen while vibrating the screen in a vertical, or near-vertical, direction. Relatively coarse particles are retained on the screen, while the finer (smaller size) particles fall through the screen openings.

Depending on the direction of screen vibration, the screen oscillation causes the particles on the screen to assume a floating fluidized condition wherein individual particles are spaced slightly from adjacent particles. The smaller size particles thereby have an improved capability for finding a screen opening for gravitational separation from the coarser particles.

Vibrating screen systems have been used for separating various types of aggregates, e.g., gravel mixtures, mixtures of stones and dirt, and dirt having agglomerated clumps of clay.

Vibrating screen systems have been embodied in trailers for towing to places where the aggregates are located. In most cases the vibrating screens have been mounted within housings that have funnel-like hoppers located above the screens. These hoppers act as guides for funnelling the aggregates onto the screen. Such hoppers are advantageous in that they form relatively wide mouths for receiving the aggregates, whereby there is a lessened possibility of aggregates missing or bypassing the screens. Also, there is a better distribution of the aggregate mass on the screen.

One disadvantage of the known mobile (trailered) screen systems is that the funnel-like hoppers are stationary, whereas the associated screens are oscillatory. The screens have to be spaced from the hopper surfaces in order to permit the desired oscillatory (vibratory) motions of the screen. The resulting clearances between the screen and hopper form concealed cracks and crevices that can serve as collection points for particles.

Particulates accumulating in such concealed cracks and crevices can eventually interfere with the oscillatory motion of the screen, to the point where the screen no longer vibrates in the desired fashion. In extreme cases the clearance areas will be sufficiently clogged to prevent the screen from vibrating entirely.

U.S. Pat. Nos. 4,237,000; 4,923,597; 4,256,572; 5,106,490; and 5,232,098, show mobile screen systems that have heretofore been proposed for use in separating aggregate mixtures into coarse and fine fractions. The present invention is concerned with a simplified mobile screen system that is an improvement on the systems shown in these patents; the principal area of improvement is that the screen is elevated above the box which receives the fine aggregates, whereby aggregates are precluded from clogging the system so as to prevent the screen from oscillating in the desired fashion. The elevated screen has two trough walls attached thereto for guiding aggregates onto the screen, whereby the screen is fully utilized.

SUMMARY OF THE PRESENT INVENTION

An object of the present invention is to provide a mobile gravel screening apparatus.

A further object of the present invention is, more particularly, to provide a mobile gravel screening apparatus having a sloped screen, and means for vibrating the screen to promote the flow of gravel through the apparatus.

In a preferred embodiment, the present invention comprises a box adapted to rest on the ground surface, and a vibratable screen assembly located above the box. Four heavy duty coil springs support the screen assembly for oscillatory motion in the space above the box, whereby aggregates deposited onto the screen achieve a fluidized condition suitable for gravitational movement of the smaller size particulates through the screen openings into the subjacent box.

Two counterweights are affixed on a transverse shaft located on the underside of the screen assembly; a hydraulic motor is arranged to rotate the shaft, whereby the counterweights are rotated around the shaft axis to oscillate the screen assembly in a generally vertical direction.

As an important feature of the invention, the elevated screen assembly includes two divergent trough walls contiguous with side edges of the screen for guiding aggregates onto the screen surface. The upper edges of the trough walls are widely spaced to provide a wide-mouthed hopper structure for receiving aggregates from an overhead source, e.g., a belt conveyor or the shovel of a front end loader.

The trough walls are integral parts of the screen assembly, so that there is no potential for particulates to become clogged between the trough and the screen assembly. As a result, the oscillation system enjoys a relatively long service life, without becoming clogged, or jammed, due to particulate accumulations.

The structure of the present invention is advantageous in that the oscillation mechanism and screen assembly are fully exposed above the particulate collection box, whereby the technician can immediately detect maintenance problems, e.g., a worn drive belt or a leaking hydraulic hose. The operating components are easily accessible so that repairs can be quickly accomplished without dismantling housing structures or other components of the system.

A principal aim of the invention is to provide a mobile vibrating screening system having a relatively long service life, and a very low maintenance expense, with minimal down time when repairs are needed.

A BRIEF DESCRIPTION OF THE DRAWINGS

DESCRIPTION OF THE PREFERRED EMBODIMENTS OF THE PRESENT INVENTION

Figure 1:
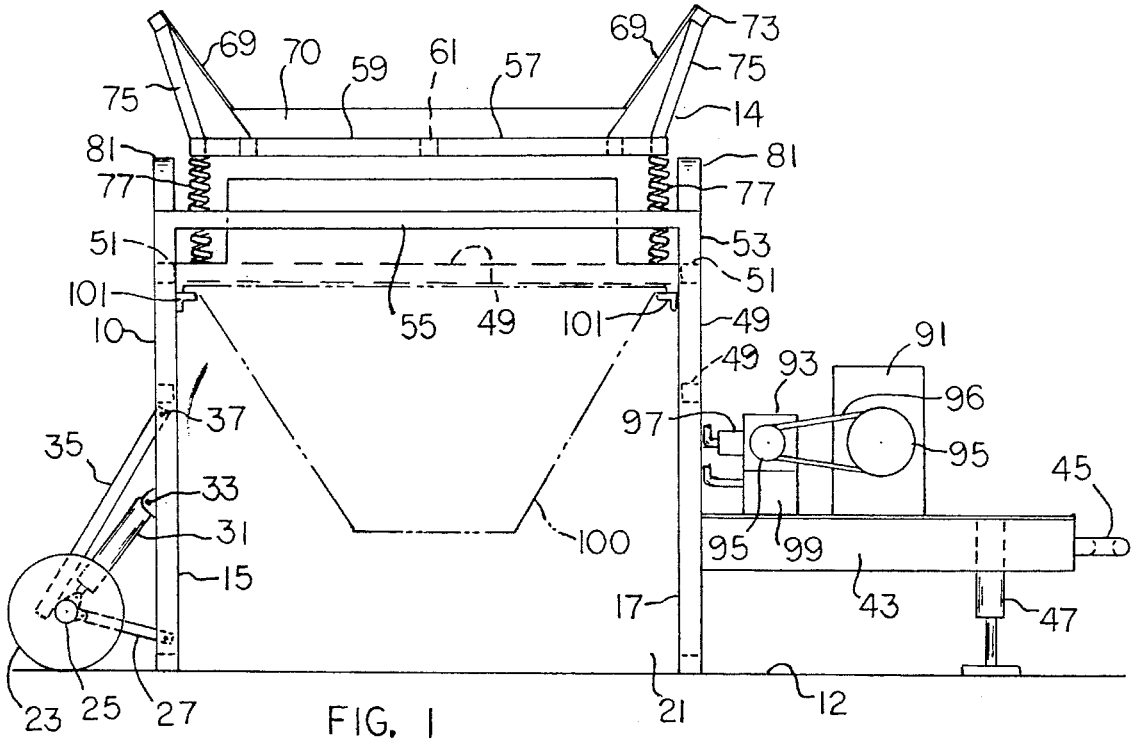
FIG. 1, is a side elevational view, of a mobile aggregate screening apparatus embodying the invention.

FIG. 1, is a side elevational view, of a mobile aggregate screening apparatus embodying the invention.

Figure 2:
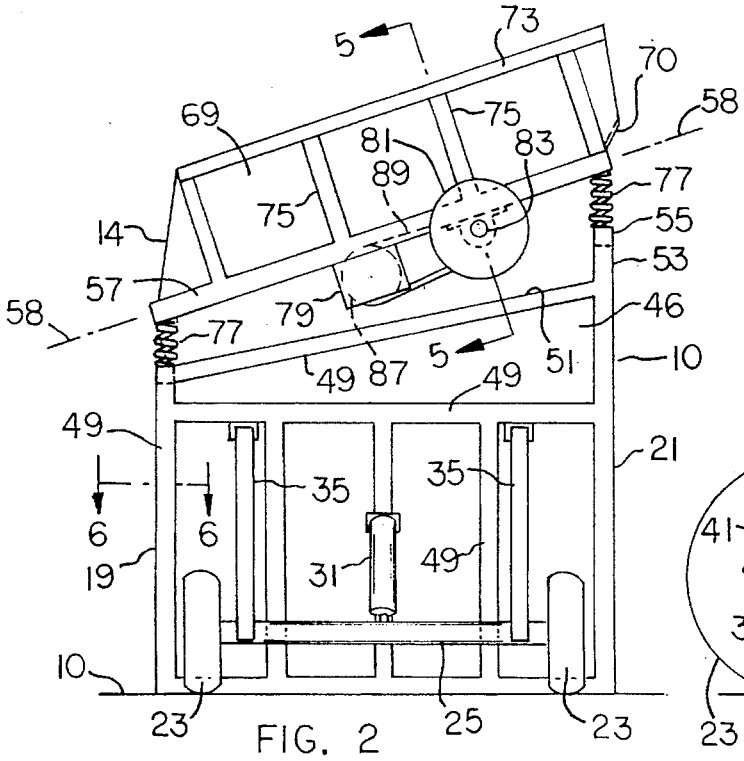
FIG. 2, is a left end elevational view, of the FIG. 1 screening apparatus.

FIG. 2, is a left end elevational view, of the FIG. 1 screening apparatus.

Figure 3:
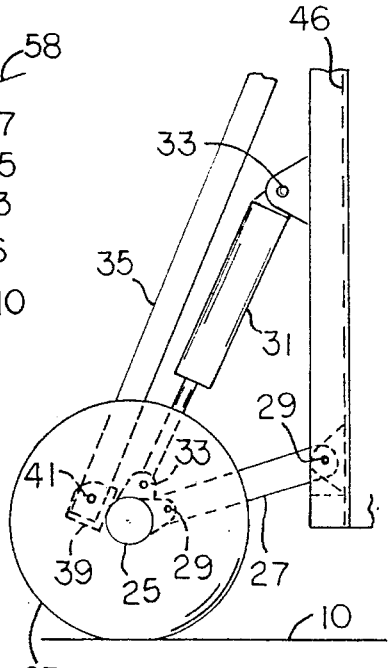
FIG. 3, is an enlarged fragmentary view, of a road wheel mounting mechanism used in the FIG. 1 apparatus.

FIG. 3, is an enlarged fragmentary view, of a road wheel mounting mechanism used in the FIG. 1 apparatus.

Figure 4:
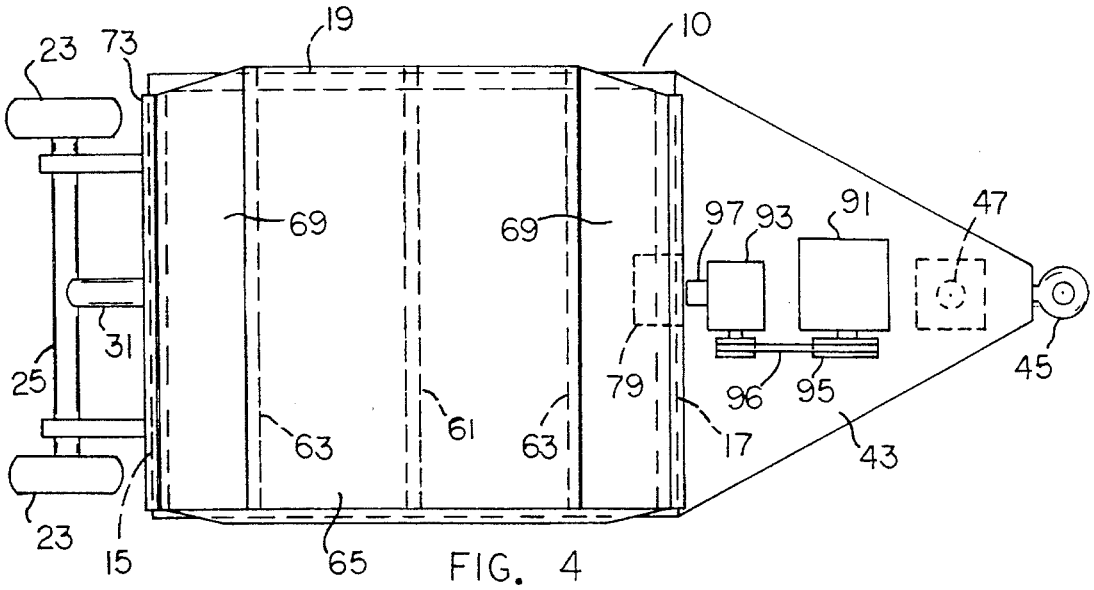
FIG. 4, is a top plan view, of the FIG. 1 apparatus.

FIG. 4, is a top plan view, of the FIG. 1 apparatus.

Referring particularly to FIGS. 1 through 4, there is shown a mobile screening apparatus designed for separating gravel aggregates into coarse and fine fractions. Depending on the mesh of the perforated screen (panel), other types of aggregates can also be accommodated. However, the illustrated apparatus has reinforcement features for resisting high impact forces generated by small rocks and high density gravel. The illustrated apparatus is therefore particularly suited for handling gravel and small rocks of varying size and shape.

The illustrated apparatus comprises an upright box 10 adapted to rest on ground surface 12 for receiving fine gravel particles from an elevated screen assembly 14. Box 10 comprises an upright rear wall 15, an upright front wall 17, and an upright side wall 19. The top end of the box 10 is open to accommodate falling aggregate particles passing through the overhead screen assembly 14. Also, one side of the box is open to gain access to fine gravel particles deposited in the box. In the drawing the open side of the box is designated by numeral 21. viewed in the top plan direction, box 10 has a U-configuration.

The illustrated apparatus is designed to be towed by another vehicle, e.g., a truck, whereby the apparatus can be relocated, as necessary to be proximate to particular gravel sources. During the transport phase, from one site to another site, box 10 is elevated from the ground surface, as fragmentarily illustrated in FIG. 3.

Two ground wheels 23 are located behind box rear wall 15 for supporting box 10 above the ground surface 12 while the apparatus is being towed. The wheels 23 are rotatably mounted on a non-rotary tubular axle 25 that is connected to the box rear wall 15 by two links 27; the links 27 have pivotal connections 29 with the axle 25 and box rear wall 15.

A hydraulic cylinder 31 has pivotal connections 33 with the box rear wall and axle, whereby the cylinder 31 is enabled to raise or lower box 10. Cylinder 31 can be a single acting cylinder connected at its upper end to a suitable hydraulic hose that supplies hydraulic fluid at a suitable pressure, e.g., 2,500 p.s.i. Cylinder 31 can have a three inch bore and a twelve inch stroke. When the cylinder 31 is pressurized, as shown in FIG. 3, the box 10 is raised from the ground surface. When the cylinder is depressurized, as shown in FIG. 1, box 10 is lowered to rest on ground surface 12.

When box 10 is in its raised condition, the weight of the box can be absorbed by two elongated tubular struts 35. Each strut 35 has a pivotal connection 37 with the box rear wall 15. The lower end of each strut can be seated in a socket member 39 (FIG. 3) attached to the axle, after cylinder 31 has raised the box 10 to its transport position. A pin 41 can be extended through aligned holes in each strut and the associated socket member 39, to retain the strut in the socket member. During the transport period, cylinder 31 can be in a depressurized condition.

The illustrated apparatus includes a platform 43 extending forwardly from the box front wall 17. As shown in FIG. 4, the platform 43 has a triangular configuration. The platform can be formed out of ten inch steel channel welded to the box front wall 17 and a steel nose plate; a towing eye 45 is mounted to the nose plate on the longitudinal axis of the apparatus. The overall length of the apparatus, from road wheels 23 to the towing eye 45, may typically be about twenty (20) feet.

A vertically disposed hydraulic cylinder 47 is suitably mounted on platform 43 for raising or lowering the front end of the apparatus. Cylinder 47 can be substantially identical to cylinder 31. As shown FIG. 1, cylinder 47 is in a depressurized condition. Cylinders 47 and 31 may be pressurized together (i.e., at the same time) to raise the apparatus to its elevated position. After the apparatus has been connected to the towing vehicle the cylinders can be depressurized.

Figure 6:
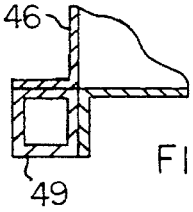
FIGS. 6, 7 and 8 are fragmentary sectional views, of structural details used in the FIG. 1 apparatus.
Figure 8:
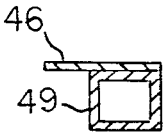
Figure 7:
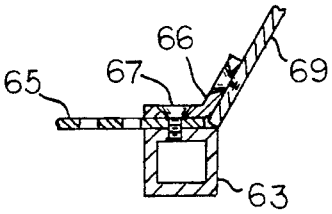
Figure 5:
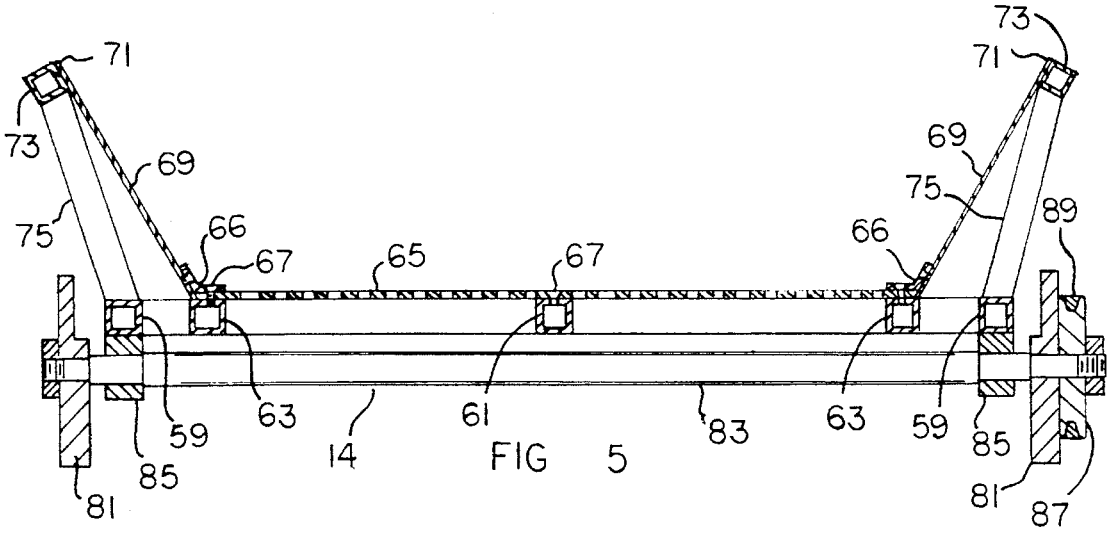
FIG. 5, is an enlarged sectional view, taken on line 5—5 in FIG. 2.

FIGS. 6, 7 and 8 are fragmentary sectional views of structural details used in the FIG. 1 apparatus.

The walls of box 10 are preferably formed of steel plate reinforced with square tubing welded to the plate outer surfaces. FIGS. 6 and 8 illustrate a preferred relationship between the steel plate and the tubular reinforcements. In the drawing, numeral 46 designates the steel plate, and numeral 49 designates the tubular reinforcement. FIG. 6 shows a corner construction, e.g., the corner formed between walls 15 and 19. FIG. 8 shows the construction at the free end of wall 15; a similar reinforcement is used at the free end of wall 17.

FIG. 2, shows a preferred reinforced wall structure for the rear wall 15, comprising horizontal and vertical tubes 49 welded together to provide a reinforcement mechanism for the steel plate that defines the interior surface of the box. Walls 19 and 17 may be reinforced in similar fashion.

Walls 15 and 17 have upper edges 51 that are sloped downwardly in the direction of side wall 19, as illustrated in FIG. 2. The upper edges of these three walls are reinforced by means of steel tubes 49. The reinforcement tubes for the end edges of walls 15 and 17 are extended upwardly, as at 53, to connect with a horizontal beam 55. Beam 55 extends between walls 15 and 17 in the plane of the box open side, to rigidify the box structure.

Screen assembly 14 comprises a rectangular frame 57 spaced above the upper edges of box walls 15, 17 and 19, such that the frame 57 is in a sloped plane 58 extending essentially parallel to upper edges 51 of walls 15 and 17. The sloped frame is defined by four steel tubes 59 welded together to form the peripheral edge of the frame. The sloped frame further comprises a center bar 61 and two side bars 63 extending between two of the peripheral steel tubes 59. Bars 61 and 63 form a support grid for a perforated panel 65 that constitutes the screen for classifying, or separating, the gravel aggregates into coarse and fine fractions. The fine particles fall through the panel perforations, while the coarse (large) particles are retained on the panel.

Perforated panel 65 can be formed in various ways, e.g., by a steel plate having holes punched at spaced points therealong, or by a heavy screen, or by a sheet of expanded metal. The perforated panel 65 is releasably secured to the supporting grid by means of two angle iron retainer strips 66 and screws 67 extended through the panel 65 into bars 61 and 63, and frame elements 59 spanning the bars.

Screen assembly 14 further comprises two upwardly divergent trough walls 69 that have lower edges thereof welded to bars 63, so that the trough walls are contiguous with perforated panel 65. Trough walls 69 act as guides for channeling gravel aggregates onto the panel surface. The trough walls have upper edges 71 that are widely spaced to contain and channel aggregates received from an overhead source, not shown. The aggregates would usually be received from an overhead belt conveyor or the bucket of a front end loader. An end wall 70 is provided at the upper end of the trough to prevent undesired movement of the fluidized aggregates off the upper edge of perforated panel (screen) 65.

The upper edges of trough walls 69 are reinforced by rectangular tubes 73 extending along the entire length of each wall 69. Walls 69 are further reinforced by means of tubular struts 75 extending between peripheral edge areas of frame 57 and reinforcement tubes 73. As shown in FIG. 2, there are four struts 75 spaced approximately equidistantly along the length of the illustrated trough wall 69. Each trough wall 69 is preferably a steel plate having a thickness of about three-sixteenths of an inch.

Screen assembly 14 is resiliently supported above box 10 by means of four heavy duty coil springs 77 trained between frame 57 and upper edge areas of the box. Two of the springs are positioned on beam 55, as shown in FIG. 1. The other two springs are seated on the upper edge of box side wall 19 directly behind the first mentioned springs (as viewed in FIG. 1). Springs 77 are located at the corners of frame 57.

Screen assembly 14 is vibrated in a generally vertical direction by a rotary counterweight system that is driven by a hydraulic motor 79 suitably fastened to the underside of frame 57. Two circular eccentric counterweights 81 are carried on the ends of a transverse shaft 83 that is mounted in bearings 85 carried by frame 57. Pulleys 87 are carried on shaft 83 and the shaft of motor 79 for accommodating a drive belt 89, whereby the motor powers the counterweights for rotation around the shaft 83 axis. The rotating counterweights produce a desired vertical oscillation of the screen assembly 14. A suitable guard screen is provided around drive belt 89 and pulleys 87.

An engine 91 is mounted on platform 43 for powering hydraulic pump 93, via a drive system that includes pulleys 95 and a drive belt 96. The pump 93 output may be regulated by a manual control valve 97, that controls the pressure in a line leading to motor 79. The return line from motor 79 connects with a sump 99 in pump 93.

Pump 93 can also supply pressure fluid to the aforementioned cylinders 31 and 47. A selector valve is provided so that the pump output is applied either to motor 79 or to cylinders 31 and 47, as necessary.

The three sided box 10 circumscribes a vacant space that receives the relatively fine particles that pass through the perforated screen 65. Normally the particles will accumulate on the ground surface within box 10. However, if desired, a container (not shown) can be positioned within box 10 to receive the relatively fine particles.

Alternatively, box 10 can be used to support a funnel-shaped hopper that guides the relatively fine particles onto a belt type conveyor, not shown. FIG. 1, shows in dashed lines a funnel-shaped hopper 100 having flanges adapted to rest on rails 101 affixed to the inner surfaces of box walls 15 and 17. The funnel-shaped hopper 100 has an open lower end adapted to discharge relatively fine particles onto the end of a belt conveyor (not shown) that conveys the particles out of the box, e.g., to a truck. Hopper 100 serves as a guide for concentrating the particle stream discharged through screen 65.

The side opening in box 10 enables the apparatus to be turned in a reverse direction for leaving a pile of gravel on ground surface 12. Thus, if the towing vehicle exerts a pulling force on eye 45 to turn the apparatus through a one hundred eighty degree arc, eye 45 will face in the opposite direction so that box 10 is clear of the gravel pile.

A principal feature of the invention is that screen assembly 14 is elevated above box 10, whereby the operating components 79, 85 and 81, are visible and readily accessible for inspection or repair purposes. Another feature of the invention is that trough walls 69 are contiguous with screen 65. There is no possibility of aggregates collecting in clearance spaces between a stationary trough and an oscillating screen; in the illustrated arrangement the trough is an integral part of the screen assembly so that the cloggage problem is eliminated.

The present invention described above, relates to a mobile gravel screening apparatus. Features of the present invention are recited in the appended claims. The drawings contained herein necessarily depict structural features and embodiments of the mobile gravel screening apparatus, useful in the practice of the present invention.

However, it will be appreciated by those skilled in the arts pertaining thereto, that the present invention can be practiced in various alternate forms and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A mobile aggregate screening apparatus comprising:

a box adapted to rest on the ground surface;

said box comprising a rear wall, a side wall, and a front wall;

said box having an open top, an open bottom, and an open side;

said box side wall comprising a horizontal tube defining the side wall upper edge;

a horizontal tubular beam extending between the box rear wall and front wall in the plane of said open side;

said horizontal beam being elevated relative to said horizontal tube;

a vibratable screen assembly located above said box;

said screen assembly comprising a rectangular frame sloped downwardly in the direction of said box side wall, a perforated panel overlying said frame, and two upwardly divergent trough walls extending upwardly from said frame for guiding aggregates onto said perforated panel;

said trough walls having lower edges in contiguous relation to said perforated panel;

two pair of coil springs for resiliently supporting said screen assembly above said box;

the springs in one pair extending between said horizontal tube and the rectangular frame; and the springs in the other pair extending between said horizontal beam and the rectangular frame.

2. The aggregate screening apparatus, as described in claim 1, wherein said frame comprises four connected peripheral tubes defining the frame peripheral edge, a center bar, and two side bars located within the space circumscribed by said peripheral tubes; and said perforated panel being supported on said center bar and two side bars.

3. The aggregate screening apparatus, as described in claim 2, wherein said upwardly divergent trough walls have lower edges contiguous with said side bars.

4. The aggregate screening apparatus, as described in claim 3, wherein said trough walls have upper edges spaced further apart than said lower edges;

a rectangular reinforcement tube extending along the upper edge of each trough wall; and a plurality of reinforcing struts extending between said frame and each reinforcement tube.

5. A mobile aggregate screening apparatus comprising:

a box adapted to rest on the ground surface;

said box comprising a rear wall, a side wall, and a front wall;

said front and rear walls having upper edges sloped downwardly in the direction of said box side wall;

a vibratable screen assembly located above said box;

said screen assembly comprising a rectangular frame located in a sloped plane approximately parallel to the plane of said sloped upper edges, a sloped perforated panel positioned on said frame, and two upwardly divergent trough walls extending upwardly from said rectangular frame in contiguous relation to said perforated panel, whereby aggregates deposited onto said trough walls are gravitationally guided onto the perforated panel;

said frame comprising a peripheral tube means (59) defining the frame peripheral edge, and a center bar and two side bars extending in planes paralleling the box rear wall and front wall;

said perforated panel having side edge areas thereof positioned on said side bars;

said upwardly divergent trough walls having lower edges contiguous with said side bars and upper edges spaced further apart than said lower edges;

a reinforcement means extending along the upper edge of each trough wall; and a plurality of reinforcing struts extending between said peripheral tube means and each said reinforcement means.

6. The aggregate screening apparatus, as described in claim 5, wherein each said reinforcement means comprises a rectangular tube extending along an upper edge of the respective trough wall.

7. The aggregate screening apparatus, as described in claim 6, wherein each reinforcing strut comprises a tube.

* * * * *